US005281513A

United States Patent [19]

Goto et al.

[11] Patent Number: 5,281,513

[45] Date of Patent: Jan. 25, 1994

[54] SILVER HALIDE PHOTOGRAPHIC MATERIAL

[75] Inventors: Takahiro Goto; Nobuaki Inoue, both of Kanagawa, Japan

[73] Assignee: Fuji Photo Film Co., Ltd., Kanagawa, Japan

[21] Appl. No.: 964,057

[22] Filed: Oct. 21, 1992

[30] Foreign Application Priority Data

Oct. 22, 1991 [JP] Japan ..... 3-301259

[51] Int. Cl.[5] ..... G03C 1/84

[52] U.S. Cl. ..... 430/512; 430/510; 430/517; 430/525; 430/606

[58] Field of Search ..... 430/510, 517, 523, 606, 430/512

[56] References Cited

U.S. PATENT DOCUMENTS 4,904,565 2/1990 Schmidt et al. .

4,988,611 1/1991 Anderson et al. .

FOREIGN PATENT DOCUMENTS 63-13033 1/1988 Japan .

WO8804794 6/1988 PCT Int'l Appl. .

*Primary Examiner*—Jack P. Brammer

*Attorney, Agent, or Firm*—Sughrue, Mion, Zinn, Macpeak & Seas

[57] ABSTRACT

A silver halide photographic material is disclosed, comprising a support having on one side thereof (1) at least one light-sensitive silver halide emulsion layer and (2) at least one light-insensitive hydrophilic colloid layer containing a dye dispersed in the form of fine solid particles in which the light-sensitive silver halide emulsion layer is located between the support and the light-insensitive layer; and having on the other side thereof at least one light-insensitive backing layer, wherein the backing layer has a absorbance at 320 to 400 nm of 0.50 to 0.90.

3 Claims, No Drawings

SILVER HALIDE PHOTOGRAPHIC MATERIAL

FIELD OF THE INVENTION

This invention relates to a silver halide photographic material, and more particularly to a silver halide photographic material which can be handled under the condition of substantially bright room.

BACKGROUND OF THE INVENTION

There is a demand that operating efficiency at the photomechanical process stage be improved in the field of printing reproduction to cope with the variety and complexity of prints.

There have been attempts to improve operating efficiency by carrying out operations under lighter circumstances during the page make-up stage and dot to dot work stage in particular. For this purpose, there have been developed exposure printers and silver halide photographic materials for plate making which can be handled under the substantially bright room conditions.

The term "silver halide photographic material for the bright room condition" as used herein refers to a photographic material which allows light containing no ultraviolet light component and having a wavelength of at least 400 nm to be used as safelight.

Heretofore, dyes capable of absorbing visible light have been added to a hydrophilic colloid layer which is farther away from the support than the sensitive silver halide emulsion layers, to increase safety against the above safelight. When the layer containing these dyes functions as a filter layer, it is necessary that the layer is selectively colored and that other layers are substantially not colored. This is because when the emulsion layers are substantially colored, not only does the coloration have an adverse photographic effect on the emulsion layers, but also the effect of the dye-containing layer as a filter layer is reduced. There are also specific problems that spread and chokability, tone variability and outline type (open face) deteriorate in dot to dot work in particular.

As a means for solving these problems, there is known a method wherein the dyes are localized in a specific layer by using dyes having a sulfo group or a carboxyl group (i.e., so-called acid dyes) as mordants.

Examples of such mordants include: ethylenically unsaturated polymers having a dialkylaminoalkyl ester residual group described in British Patent 685,475; reaction products of polyvinyl alkyl ketones with aminoguanidine described in British Patent 850,281; and vinylpyridine polymers and vinylpyridinium cation polymers described in U.S. Pat. Nos. 2,548,564, 2,484,430, 3,148,061 and 3,756,814. Cationic polymer mordants having a sec- or tert-amino group, a nitrogen-containing heterocyclic group or a quaternary cationic group thereof, are used to mordant effectively the acid dyes.

As a means for retaining the dyes in a specific layer of the photographic material, there is known a method wherein the dyes are allowed to exist as dispersed solids as described in JP-A-56-12639 (the term "JP-A" as used herein means an "unexamined published Japanese patent application"), JP-A-55-155350, JP-A-55-155351, JP-A-52-92716, JP-A-59-193447, JP-A-61-198148, JP-A-63-197943, JP-A-63-27838, JP-A-64-40827, European Patents 0015601Bl and 0276566Al and PCT(WO) 88/04794.

However, there is still the problem that it is impossible that the tone reproducibility required for photographic materials for dot to dot work cannot be fully satisfied.

When a selectively colored filter layer is provided and the emulsion layers are not colored, a larger amount of a dye for absorbing visible light must be used in comparison with the photographic materials in which the emulsion layers are colored to retain safety against safelight and safety against external light from backing layers. However, when the amount of the dye is too large, problems of tone variability deterioration and residual color after processing are caused.

SUMMARY OF THE INVENTION

An object of the present invention is to provide a silver halide photographic material which is free of the above-described problems.

Another object of the present invention is to provide a silver halide photographic material which satisfies specific performance requirements for photographic materials for dot to dot work, that is, tone reproducibility, tone variability and spreadability, and chokability, which can be handled under the bright room conditions, and which does not form any residual color.

The above-described objects of the present invention have been achieved by a silver halide photographic material comprising a support having thereon at least one light-sensitive silver halide emulsion layer, a light-insensitive hydrophilic colloid layer containing a dye in the form of fine solid particles dispersed therein and a light-insensitive backing layer. The emulsion layer is located between the support and the light-insensitive hydrophilic colloid layer. The light-insensitive backing layer is provided on the opposite side of the support to the emulsion layer side, wherein said backing layer has an absorbance of 0.5 to 0.90, at 320 to 400 nm.

DETAILED DESCRIPTION OF THE INVENTION

The present invention is illustrated in more detail below.

Dyes which can be dispersed as crystallite solids in the present invention include dyes described in Tables I to X of WO(PCT) 88/04794, compounds represented by formulas (I) to (VII), as well as other compounds:

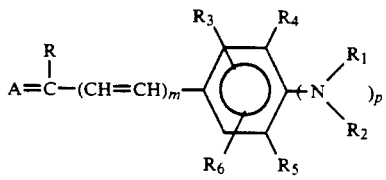

(I)

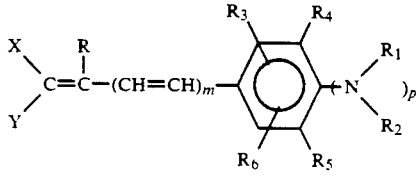

(II)

$$A{=}L_1{-}(L_2{=}L_3)_n{-}A' \quad \text{(III)}$$

$$A{=}(L_1{-}L_2)_{2-q}{=}B \quad \text{(IV)}$$

-continued

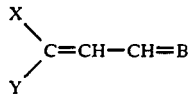
(V)

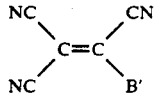
(VI)

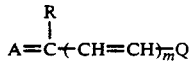
(VII)

In the above formulas, A and A' may be the same or different and each represents an acid nucleus such as 2-pyrazoline 5-one, rhodanine, hydantoin, thiohydantoin, 2,4-oxazolidinedione, isooxazolidinone, barbituric acid, thiobarbituric acid, indanedione, pyrazolopyridine and hydroxypyridone; B represents a basic nucleus; X and Y may be the same or different and each represents an electron attractive group such as cyano, carboxyl, alkylcarbonyl, arylcarbonyl, alkoxycarbonyl, aryloxycarbonyl, carbamoyl, sulfonyl and sulfamoyl; R represents a hydrogen atom or an alkyl group (preferably having 1 to 10 carbon atoms); $R_1$ and $R_2$ each represents an alkyl group (preferably having 1 to 20 carbon atoms), an aryl group, an acyl group or a sulfonyl group, or $R_1$ and $R_2$ may combine together to form a five-membered or six-membered ring; $R_3$ and $R_6$ each represents a hydrogen atom, a hydroxyl group, a carboxyl group, an alkyl group (preferably having 1 to 10 carbon atoms), an alkoxy group (preferably having 1 to 10 carbon atoms) or a halogen atom; $R_4$ and $R_5$ each represents a hydrogen atom or a non-metallic atomic group required for forming a five-membered or six-membered ring when $R_1$ and $R_4$ or $R_2$ and $R_5$ combine together; $L_1$, $L_2$ and $L_3$ each represents a methine group; m represents 0 or 1; n and q each represents 0, 1 or 2; p represents 0 or 1, provided that when p is 0, $R_3$ is a hydroxyl group or a carboxyl group and $R_4$ and $R_5$ are each hydrogen atoms; B' represents a heterocyclic moiety having a carboxyl group, a sulfamoyl group or a sulfonamide group; and Q represents a heterocyclic group.

The compounds represented by formulas (I) to (VII) have at least one dissociable group per molecule which is dissociated at a pKa of 4 to 11 in a mixed solution of water and ethanol (1:1 by volume).

Specific examples of the dyes which can be dispersed in the form of fine solid particle in the present invention include those described in WO(PCT) 88/04794, European Patents (EP) 0274723Al, 276,566 and 299,435, JP-A-52-92716, JP-A-55-155350, JP-A-55-155351, JP-A-61-205934, JP-A-48-68623, JP-A-2-282244, U.S. Pat. Nos. 2,527,583, 3,586,897, 3,746,539, 3,933,798, 4,130,429 and 4,040,841, European Patent Application Nos. 385461A and 430186A. Dispersion methods are also described in the specifications of the above-described patents. Examples thereof include a method wherein a dye is mechanically dispersed in the form of fine solid particles in water in a ball mill, a sand mill or a colloid mill by using an appropriate dispersant; a method wherein a dye in the form of a salt in a dissociated state is coated and acidic gelatin is then coated thereon to thereby carry out dispersion fixing during coating; a method wherein pH is adjusted so as to allow a dye to be dissolved to obtain an aqueous alkaline solution, and the pH is then lowered in the presence of protective colloid such as gelatin to form fine solid precipitates; and a method wherein a dye is dissolved in an appropriate solvent and a poor solvent for the dye is then added thereto to deposit the dye, thus obtaining dispersed solids.

The preferred dyes which can be used in the present invention are those having an absorption maximum in the range of 300 to 500 nm. Specific examples of the dyes which can be used in the present invention include, but are not limited to, the following compounds:

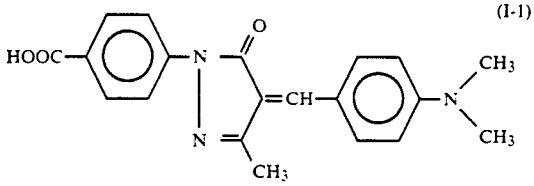
(I-1)

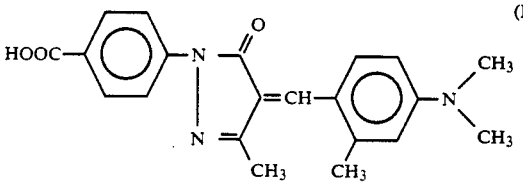
(I-2)

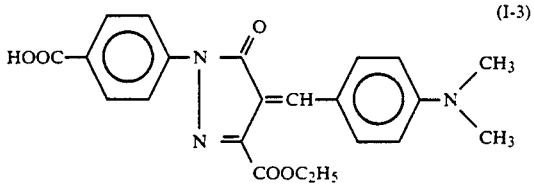
(I-3)

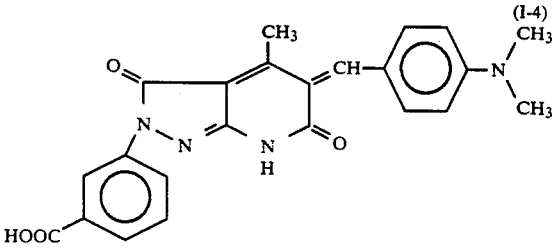
(I-4)

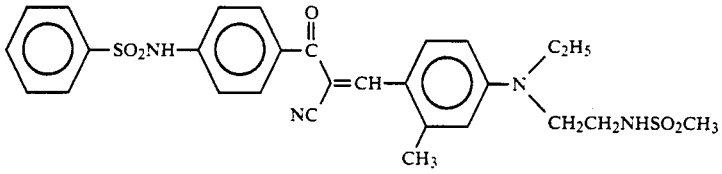
(II-1)

-continued (III-1)

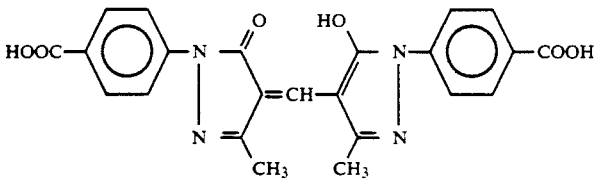

(III-2)

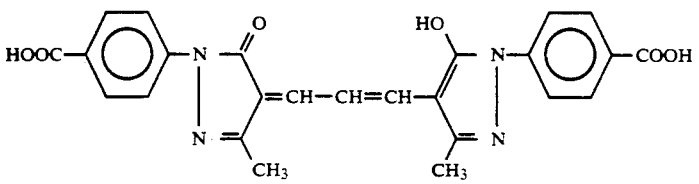

(III-3)

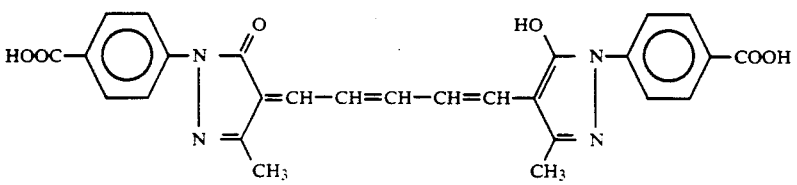

(III-4)

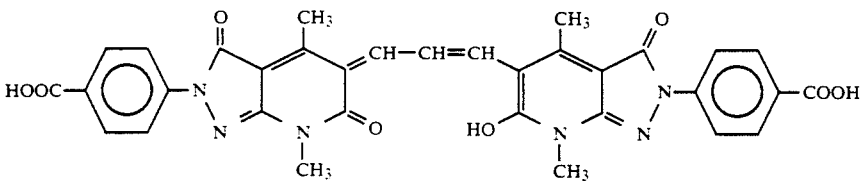

(III-5)

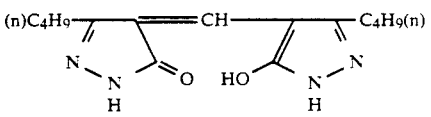

(IV-1)

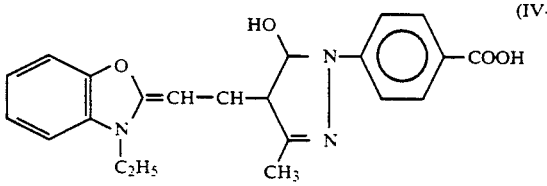

(V-1)

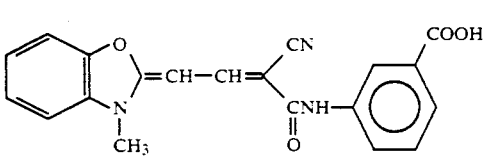

(VI-1)

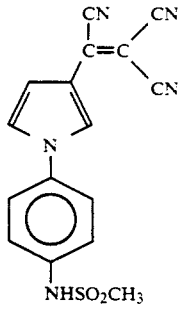

(VII-1)

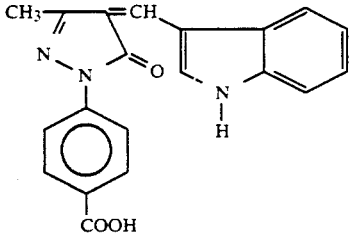

(VII-2)

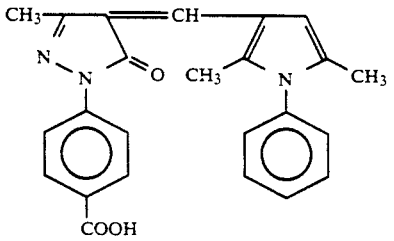

The dyes which are dispersed in the form of fine solid particles in the form of crystallite in the present invention can be handled in a bright room which cuts an ultraviolet light. The dyes are added to a light-insensitive layer which is provided on or over the emulsion layer side and is farther away from the support than the emulsion layer to improve spreadability and chokability and outline typeability. The coating weights of the dyes are preferably 10 to 500 mg/m$^2$, particularly preferably 50 to 300 mg/m$^2$.

The dyes which can be used in the present invention can be easily synthesized by the methods described in WO(PCT) 88/04794, European Patents (EP) 0274723Al, 276,566 and 299,435, JP-A-52-92716, JP-A-55-155350, JP-A-55-155351, JP-A-61-205934, JP-A-48-68623, JP-A-2-282244, U.S. Pat. Nos. 2,527,483, 3,486,897, 3,746,539, 3,933,798, 4,130,429 and 4,040,841, European Patent Application Nos. 385461A and 430186A.

The backing layer of the silver halide photographic material of the present invention contains a dye to ensure safety against safelight and safety against external light from the backing layer side. Any water-soluble dye or a dye which are dispersed in the form of fine solid particles can be used without limitation. However, water-soluble dyes are preferred as the dyes to be contained in the backing layer. The coating weights of the dyes in the backing layer are in the range of generally 50 to 2000 mg/m$^2$ and preferably 100 to 600 mg/m$^2$, and the absorbance thereof at 320 to 400 nm is in the range of generally 0.50 to 0.90 and preferably 0.60 to 0.85.

The water-soluble dyes for the backing layer which are used in the present invention are dyes having absorptions predominantly in the wavelength region of visible light in the wavelength region of light which is inherently sensitive to the silver halide emulsions used. Among them, dyes having $\lambda_{max}$ in the range of 350 to 600 nm are preferred. Oxonol dyes, hemioxonol dyes, merocyanine dyes, cyanine dyes and azo dyes can be used without particular limitation with regard to their chemical structures.

Concretely, examples of the dyes which can be used in the backing layer of the present invention include pyrazolone dyes described in JP-B-58-12576 (the term "JP-B" as used herein means an "examined Japanese patent publication"); pyrazolone oxonol dyes described in U.S. Pat. No. 2,274,782; diarylazo dyes described in U.S. Pat. No. 2,956,879; styryl dyes and butadienyl dyes described in U.S. Pat. Nos. 3,423,207 and 3,384,487; merocyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

Silver halide grains in the silver halide emulsions of the silver halide photographic material of the present invention have a mean grain size of preferably not larger than 0.20 μm, particularly preferably 0.08 to 0.16 μm.

In the present invention, the silver halide grains are prepared under such mixing conditions that the reaction temperature is generally not higher than 50° C., preferably not higher than 40° C., at a silver potential of generally at least 70 mV, preferably 300 to 500 mV or at a silver potential of 80 to 120 mV, in the presence of a stabilizer such as 6-cyclopentane-4-hydroxy-1,3,3a,7-tetraazaindene, under sufficiently high-speed stirring conditions to conduct uniform mixing. In this manner, good results can be obtained.

Grain size distribution is preferably a monodisperse system, though there is no particular limitation in that regard. The term "monodisperse" as used herein refers to a system in which at least 95% (in terms of the weight of grains or the number of grains) of the grains are grains having a grain size which is within generally a mean grain size of ±40%, preferably a mean grain size of ±20%.

It is preferred that the silver halide grains of the present invention have a regular crystal form such as a cube or octahedron. Cubic form is particularly preferred. It is also preferred that a transition metal is incorporated into the silver halide grains.

Transition metals which can be preferably used in the present invention are transition metal-coordinated complexes. There are preferred six-coordinated complexes represented by the following formula:

$$[M(NY)_mL_{6-m}]^n$$

wherein M is a transition metal selected from the group consisting of Groups V to VIII elements of the Periodic Table; L is a crosslinking ligand; Y is an oxygen or sulfur atom; m is 0, 1 or 2; and n is 0, −1, −2 or −3.

Preferred examples of L include halide ligands (fluoride, chloride, bromide and iodide), cyanide ligands, cyanate ligands, thiocyanate ligands, selenocyanate ligands, tellurocyanate ligands, acido ligands and aquo ligands. When the complexes have aquo ligands, it is preferred that one or two of ligands are aquo ligands.

Particularly preferred metals represented by M are rhodium, ruthenium, rhenium, osmium and iridium.

Examples of the transition metal coordinated complexes include the following compounds:

1. $Rh(H_2O)Cl_5]^{-2}$
2. $[RuCl_6]^{-3}$
3. $[Ru(NO)Cl_5]^{-2}$
4. $[RhCl_6]^{-3}$
5. $[Ru(H_2O)Cl_5]^{-2}$
6. $[Ru(NO)(H_2O)Cl_4]^{-1}$
7. $[Re(NO)Cl_5]^{-2}$
8. $[Os(NO)Cl_5]^{-2}$
9. $[Ir(NO)Cl_5]^{-2}$
10. $[Ir(H_2O)Cl_5]^{-2}$
11. $[Re(H_2O)Cl_5]^{-2}$
12. $[RhBr_6]^{-2}$
13. $Os(NS)Cl(SCN)_4]^{-2}$
14. $[ReCl_6]^{-3}$
15. $[IrCl_6]^{-3}$
16. $Re(NS)Cl_4(SeCN)]^{-2}$

The metal complexes can be incorporated into the silver halide grains by adding them during the preparation of the grains.

The content of the transition metal in the silver halide grains of the present invention is generally at least $1\times10^{-7}$ mol, preferably $1\times10^{-6}$ to $5\times10^{-4}$ mol, particularly preferably $5\times10^{-6}$ to $2\times10^{-4}$ mol, per mol of silver halide. Two or more transition metals may be used in combination.

It is preferred that a larger amount of the transition metal exists in the surface layer of the grain in comparison to the amount of the transition metal present in the interior of the grain, though there is no particular limitation with regard to the distribution of the transition metal.

The silver halide emulsions of the silver halide photographic material of the present invention may comprise silver chlorobromide or silver chloroiodobromide having a silver chloride content of at least 70 mol %. When the proportion of silver bromide or silver iodide is increased, safety against safelight under bright room conditions deteriorates or a γ (gamma) value is lowered.

The silver halide emulsions of the present invention may be or may be not chemical-sensitized. The methods for chemical sensitization of the silver halide emulsions include conventional methods such as sulfur sensitization, reduction sensitization and noble metal sensitization. These chemical sensitization methods may be used either alone or in combination.

A typical example of the noble metal sensitization is a gold sensitization method using gold compounds such as gold complex salts. In addition to the gold compounds, other noble metals such as complex salts of platinum, palladium and iridium may be used. Concrete examples thereof are described in U.S. Pat. No. 2,448,060 and British Patent 618,061.

Sulfur sensitizing agents include sulfur compounds contained in gelatin and other sulfur compounds such as thiosulfates, thioureas, thiazoles and rhodanines.

Reduction sensitizing agents include stannous salts, amines, formamidinesulfinic acid and silane compounds.

The photographic emulsions and light-insensitive hydrophilic colloid layers of the present invention may contain organic or inorganic hardening agents.

Examples of these hardening agents include active vinyl compounds (e.g., 1,3,5-triacryloyl-hexahydro-S-triazine, bis(vinylsulfonyl)methyl ether, N,N-methylenebis-[β-(vinylsulfonyl)propionamide]), active halogen compounds (e.g., 2,4-dichloro-6-hydroxy-S-triazine), mucohalogenic acids (e.g., mucochloric acid), N-carbamoylpyridinium salts (e.g., (1-morpholi)-carbonyl-3-pyridino)methanesulfonate), and haloamidinium salts (e.g., (1-(1-chloro-1-pyridinomethylene)pyrrolidinium 2-naphthalenesulfonate). Among them, the active vinyl compounds described in JP-A-53-41220, JP-A-53-57257, JP-A-59-162546 and JP-A-60-80846 and the active halides described in U.S. Pat. No. 3,325,287 are preferred.

The photographic emulsion layers and other hydrophilic colloid layers of the photographic material of the present invention may contain various surfactants to aid coating or to improve antistatic properties, to improve a sliding property and emulsifying dispersion, to prevent adhesion or to improve photographic characteristics (e.g., development acceleration, high contrast, sensitization), etc.

Examples of these surfactants include nonionic surfactants such as saponin (steroid), alkylene oxide derivatives (e.g., polyethylene glycol, polyethylene glycol/-polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone), glycidols (e.g., alkenylsuccinic acid polyglycerides, alkylphenol polyglycerides), fatty acid esters of polyhydric alcohols and alkyl esters of sugar; anionic surfactants having an acid group such as a carboxyl group, a sulfo group, a phospho group, a sulfuric acid ester group or a phosphoric acid ester group, such as alkylcarboxylates, alkylsulfonates, alkylbenzenesulfonates, alkylnaphthalenesulfonates, alkylsulfonic acid esters, alkylphosphoric acid esters, N-acyl-N-alkyltaurines, sulfosuccinic acid esters, sulfoalkylpolyoxyethylene alkylphenyl ethers and polyoxyethylene alkylphosphoric acid esters; amphoteric surfactants such as amino acids, aminoalkylsulfonic acids, aminoalkylsulfonic acid or aminoalkyl acid esters, alkylbetaines and amine oxides; and cationic surfactants such as alkylamine salts, aliphatic or aromatic quaternary ammonium salts, heterocyclic quaternary ammonium salts such as pyridinium salts and imidazolium salts and aliphatic or heterocyclic phosphonium salts or sulfonium salts.

It is preferred that fluorine-containing surfactants described in JP-A-60-80849 are used to impart antistatic properties.

In the light-sensitive material of the present invention, silica, magnesium oxide and polymethylmethacrylate may be contained as a matting agent in the photographic emulsion layer or the hydrophilic colloid layer to prevent adhesion of the material.

The light-sensitive material of the present invention may contain dispersions of water-insoluble or sparingly water soluble synthetic polymers to provide dimensional stability. Examples of these polymers include homopolymers of alkyl (meth)acrylates, alkoxyacryl (meth)acrylates or glycidyl (meth)acrylate or copolymers of two or more of these monomers and polymers of these monomers with another monomer such as acrylic acid or methacrylic acid.

Gelatin can be advantageously used as a binder or protective colloid. However, other hydrophilic colloids can also be used. Examples thereof include protein such as gelatin derivatives, graft polymers of gelatin with other high molecular weight materials, albumin and casein; cellulose derivatives such as hydroxyethyl cellulose, carboxymethyl cellulose and cellulose sulfate; sugar derivatives such as sodium alginate and starch derivatives; and synthetic hydrophilic high-molecular weight materials such as homopolymers, for example, polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole and copolymers thereof.

Examples of gelatin which can be used include lime-processed gelatin, acid-processed gelatin, gelatin hydrolyzate and enzymatic decomposition product of gelatin.

The silver halide emulsion layers of the present invention may contain latex of polymers such as alkyl acrylates.

Examples of the support for the light sensitive material of the present invention include cellulose triacetate, cellulose diacetate, nitrocellulose, polystyrene or polyethylene terephthalate paper, baryta-coated paper and polyolefin-coated paper.

Any of developing agents can be used in the developing solutions for the photographic material of the present invention. However, dihydroxybenzenes are preferred from the viewpoint of easily obtaining good quality of halftone dots. A combination of dihydroxybenzenes with 1-phenyl-3-pyrazolidones or a combination of dihydroxybenzenes with p-aminophenols is often used.

Examples of the dihydroxybenzene developing agents which can be used with the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Among them, hydroquinone is particularly preferred.

Examples of 1-phenyl-3-pyrazolidone and derivatives thereof which can be used as the developing agents with the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

Examples of the p-aminophenol developing agents which can be used with the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Among these, N-methyl-p-aminophenol is particularly preferred.

The developing agents are used in an amount of preferably 0.05 to 0.8 mol/l. When the dihydroxybenzenes are used in combination with the 1-phenyl-3-pyrazolidones or the p-aminophenols, it is preferred that the former is used in an amount of 0.05 to 0.5 mol/l and the latter is used in an amount of not more than 0.06 mol/l.

Examples of sulfites which can be used as preservatives in the present invention include sodium sulfite, potassium sulfite, lithium sulfite, ammonium sulfite, sodium bisulfite, potassium metabisulfite and formaldehyde-sodium bisulfite adduct. The sulfites are used in an amount of preferably at least 0.3 mol/l, particularly at least 0.4 mol/l. The upper limit is preferably 2.5 mol/l, particularly preferably 1.2 mol/l.

Examples of alkaline agents which can be used to set pH include pH adjustors or buffering agents such as sodium hydroxide, potassium hydroxide, sodium carbonate, potassium carbonate, sodium tertiary phosphate, potassium tertiary phosphate, sodium silicate and potassium silicate.

Examples of other additives which can be used in addition to the above components in the present invention include a development inhibitor compounds such as boric acid and borax, sodium bromide, potassium bromide and potassium iodide; organic solvents such as ethylene glycol, diethylene glycol, triethylene glycol, dimethylformamide, methyl cellosolve, hexylene glycol, ethanol and methanol; and anti-fogging agents such as mercapto compounds (e.g., 1-phenyl-5-mercaptotetrazole, sodium 2-mercaptobenzimidazole-5-sulfonate), indazole compounds (e.g., 5-nitroindazole) and benztriazole compounds (e.g., 5-methylbenztriazole). If desired, the developing solutions may contain a toning agent, a surfactant, an anti-foaming agent, a hard water softener, a hardening agent, etc. The amino compounds described in JP-A-56-106244 and imidazole compounds described in JP-B-48-35493 are particularly preferred from the viewpoint of accelerating development or increasing sensitivity.

The developing solutions of the present invention may contain the silver stain inhibitors described in JP-A-56-24347, the uneven development inhibitors described in JP-A-62-212651 and the dissolution aids described in JP-A-61-267759.

The developing solutions of the present invention may contain, as buffering agents, boric acids described in JP-A-62-186259 and the saccharides (e.g., saccharose), oximes (e.g., acetoxime), phenols (e.g., 5-sulfosalicylic acid) and tertiary phosphates (e.g., sodium salt, potassium salt) described in JP-A-60-93433. Among these, boric acid are preferred as buffering agents.

The fixing solution is an aqueous solution containing a fixing agent and optionally a hardening agent (e.g., a water-soluble aluminum compound), acetic acid and a dibasic acid (e.g., tartaric acid, citric acid or a salt thereof) and having a pH of preferably not lower than 3.8, more preferably 4.0 to 5.5.

Examples of the fixing agent include sodium thio sulfate and ammonium thiosulfate. Ammonium thiosulfate is particularly preferred from the viewpoint of its rate of fixing. The amount of the fixing agent can be varied and is generally about 0.1 to 5 mol/l.

Water-soluble ammonium salts which mainly function as hardening agents in the fixing solution are compounds generally known as hardening agents in hardening acid fixers. Examples thereof include aluminum chloride, aluminum sulfate and potash alum.

The above-described dibasic acids include tartaric acid and derivatives thereof and citric acid and derivatives thereof, either singly or a combination of two or more. An effective amount of the dibasic acid used is at least 0.005 mol per liter of the fixing solution, and preferably 0.01 to 0.03 mol per liter of the fixing solution.

Concrete examples of the tartaric acid compounds include tartaric acid, potassium tartrate, sodium tartrate, potassium sodium tartrate, ammonium tartrate and ammonium potassium tartrate.

Examples of the citric acid and derivatives thereof which can be effectively used in the present invention include citric acid, sodium citrate and potassium citrate.

The fixing solution may optionally contain preservatives (e.g., sulfites, bisulfites), pH buffering agents (e.g., acetic acid, boric acid), pH adjustors (e.g., ammonia, sulfuric acid), image storage improvers (e.g., potassium iodide) and chelating agents. The pH buffering agents are used in an amount of preferably 10 to 40 g/l, more preferably 18 to 25 g/l, because the pH of the developing solution is high.

The fixing temperature and time are preferably about 20° to about 50° C. for 10 seconds to one minute as in the development stage.

Rinsing water may contain antimolding agents (e.g., the compound described in Horiguchi, *Antibacterial and Antifungal Chemistry* and JP-A-62-115154), rinsing accelerators (e.g., sulfites) and chelating agents.

After development and fixing, the photographic material is washed with water and dried. Rinsing is carried out to remove almost completely the silver salt dissolved by fixing. Preferably, rinsing is carried out at a temperature of about 20° to about 50° C. for 10 seconds to 3 minutes. Drying is carried out at a temperature of about 40° to about 100° C. The drying time varies depending on circumferential conditions, but is generally about 5 seconds to 3 minutes and 3 seconds.

Roller convey type automatic processors are described in U.S. Pat. Nos. 3,025,779 and 3,545,971 and are referred to herein simply as roller convey type processor. The roller convey type processor comprises the four stages of development, fixing, rinsing and drying. In the present invention, the four stage processing is most preferred, though other stages (e.g., a stop stage) may be optionally added with the present invention. A rinsing stage can be carried out in a water saving manner when a two or three stage counter-current system is used.

It is preferred that the developing solutions of the present invention are stored in a packaging container having a low oxygen permeability as described in JP-A-61-73147. A replenishment system described in JP-A-62-91939 can be preferably used for the developing solutions of the present invention.

The silver halide photographic material of the present invention gives a high Dmax. Accordingly, when the photographic material of the present invention is subjected to a reduction treatment, a high density can be retained even if dot area is reduced.

Any of reducers described in Meeds, *The Theory of the Photographic Process*, pp. 738-744 (1954 Macmillan), Tetsuo Yano, *Theory and Practice of Photographic Processing*, pp. 166-169, (1978 Kyoritsu Shuppan), JP-A-50-27543, JP-A-52-68429, JP-A-55-17123, JP-A-55-79444, JP-A-57-10140, JP-A-57-142639 and JP-A-61-61155 can be used without particular limitation. Specific examples of the reducers include: reducers containing permanganates, persulfates, ferric salts, cupric salts, ceric salts, red prussiate of potash and dichromates as oxidizing agents either singly or in combination and optionally inorganic acids such as sulfuric acid and alcohols; and reducers containing oxidizing agents such as red prussiate of potash or ethylenediaminetetraacetato ferrate (III), solvents for silver halide such as thiosulfates, rhodanides, thiourea or derivatives thereof and optionally inorganic acids such as sulfuric acid.

Typical examples of the reducers which can be used in the present invention include Farmer's reducer, ethylenediaminetetraacetato ferrate (III), potassium permanganate, ammonium persulfate reducers (Kodak R5) and ceric salt reducer.

Reduction processing is generally carried out at a temperature of 10° to 40° C., preferably 15° to 30° C., and preferably completed within several seconds to several tens of minutes (particularly preferably within several minutes). When the photographic material for plate making according to the present invention is used, a sufficiently wide reduction margin can be obtained under the above conditions.

The reducers have an effect on the silver image formed in the emulsion layer through the upper light-insensitive layer containing the compounds of the present invention.

Reduction processing can be carried out in various manners, for example, by a method wherein the photographic material for plate making is immersed in the reducer and the reducer is stirred, or a method wherein the reducer is applied to the surface of the photographic material for plate making by means of a writing brush or a roller.

The present invention is now illustrated in greater detail by reference to the following examples which, however, are not to be construed as limiting the present invention in any way.

EXAMPLE 1

Preparation of Emulsion

Emulsion A

To an aqueous gelatin solution containing $5\times10^{-3}$ mol of 5,6-cyclopentane-4-hydroxy-1,3,3a,7-tetrazaindene per mol of silver kept at 40° C., there were simultaneously added an aqueous solution of silver nitrate and an aqueous sodium chloride solution containing $4\times10^{-5}$ mol of $(NH_4)_2Rh(H_2O)Cl_5$ per mol of silver over a period of 3.5 minutes while potential was controlled to 95 mV to thereby prepare grains of 0.08 μm as a core part. Subsequently, an aqueous solution of silver nitrate and an aqueous sodium chloride solution containing $1.2\times10^{-4}$ mol of $(NH_4)_2Rh(H_2O)Cl_5$ per mol of silver were simultaneously added thereto over a period of 7 minutes while potential was controlled to 95 mV to thereby prepare silver chloride cubic grains having a mean grain size of 0.10 μm.

Preparation of Coated Sample

To the above emulsion, were added 5,6-cyclopentane-4-hydroxy-1,3,3a,7-tetrazaindene (24 mg/m$^2$), ethyl acrylate latex (average particle size: 0.05 μm, 770 mg/m$^2$), the compound having the following structure (3 mg/m$^2$) and 2-bis(vinylsulfonylacetamido)ethane (126 mg/m$^2$).

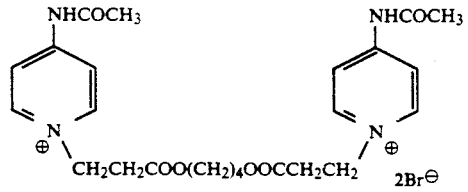

The emulsion was coated on a polyester support in such an amount as to give a coating weight of 3.0 g/m$^2$ in terms of silver. The coating weight of gelatin was 1.3 g/m$^2$.

A lower protective layer comprising gelatin (0.8 g/m$^2$), lipoic acid (8 mg/m$^2$), $C_2H_5SO_2SNa$ (6 mg/m$^2$) and ethyl acrylate latex (average particle size: 0.05 μm, 230 mg/m$^2$) was coated thereon. Further, an upper protective layer comprising gelatin (0.7 g/m$^2$) and the dye (in the state dispersed in the form of fine solid particles) indicated in Table 1 was coated thereon. In this case, a matting agent (silicon dioxide having an average particle size of 3.5 μm, 55 mg/m$^2$), methanol silica (average particle size: 0.02 μm, 135 mg/m$^2$), sodium dodecylbenzenesulfonate (25 mg/m$^2$) as coating aids, sulfuric acid ester sodium salt of poly(degree of polymerization: 5)oxyethylene nonylphenyl ether (20 mg/m$^2$) and a potassium salt of N-perfluorooctanesulfonyl-N-propylglycine (3 mg/m$^2$) were simultaneously coated to prepare a sample.

The base used in this Example had the following backing layer and backing protective layer (the swelling ratio of the back side was 110%):

| | |
|---|---|
| Backing layer | |
| Gelatin | 170 mg/m$^2$ |
| Sodium dodecylbenzenesulfonate | 32 mg/m$^2$ |
| Dihexyl sodium α-sulfosuccinate | 35 mg/m$^2$ |
| $SnO_2$/Sb (9:1) by weight, average particle size: 0.25 μm) | 318 mg/m$^2$ |
| Backing protective layer | |
| Gelatin | 2.7 g |
| Matting agent (silicon dioxide having an average particle size: 3.5 μm) | 26 mg/m$^2$ |
| Dihexyl sodium α-sulfosuccinate | 20 mg/m$^2$ |
| Sodium dodecylbenzenesulfonate | 67 mg/m$^2$ |
| $C_8F_{17}SO_2N(C_3H_7)-(CH_2CH_2O)_n-(CH_2)_4-SO_3Li$ | 5 mg/m$^2$ |
| Dye B | 32 mg/m$^2$ |
| Dye C | 59 mg/m$^2$ |

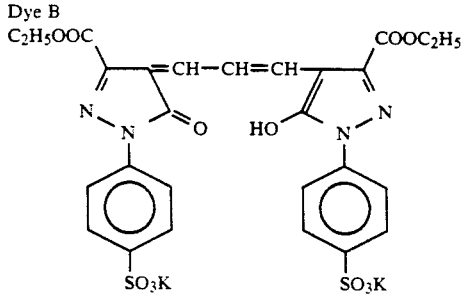

-continued

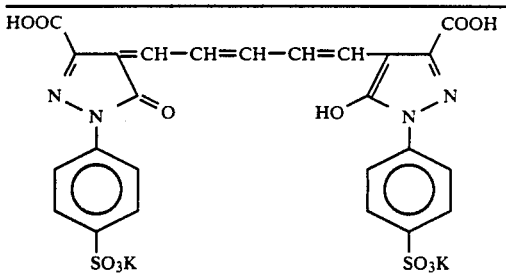

| | |
|---|---|
| Ethyl acrylate latex (average particle size: 0.05 μm) | 260 mg/m² |
| 1,3-Divinylsulfonyl-2-propanol | 149 mg/m² |

Water-soluble dyes shown in Table 1 were coated.

Photographic Performance

The thus-obtained samples were exposed through an optical wedge by using P-627 FM printer (mercury) (manufactured by Dainippon Screen KK), developed at 38° C. for 20 seconds by using the developing solution LD-835 (manufactured by Fuji Photo Film Co., Ltd.) and the automatic processor FG 800RA (manufactured by Fuji Photo Film Co., Ltd.), fixed, washed with water and dried. The samples were evaluated for the following items:

(1) Sensitivity

The reciprocal of the exposure amount giving a density of 0.1 is referred to as the sensitivity. The sensitivity is represented in terms of relative sensitivity when the sensitivity of Sample No. 1 is referred to as 100.

(2) Dmax

A film (the halftone original) wherein a half-tone image is formed on a mounting base is fixed by means of an adhesive tape. The film (halftone original) and each sample film are put upon each other so as to allow the surface of the protective layer and the surface of the halftone original to be brought into close contact with each other. The maximum blackening density is referred to as Dmax when the exposure is made so that 50% of dot areas gives 50% dot present on the film sample.

(3) Gradation (1.5-0.1)/1-{log(exposure amount giving a density of 0.1)-log(exposure amount giving a density of 1.5)}

(4) Safelight property

The safelight property is represented by the irradiation time of an anti-fading fluorescent lamp (FLR 40SW-DL-X NU/M manufactured by Toshiba Corporation) (said irradiation time causes that dots to be originally 50% are spread by 2%) when the sample is irradiated by using said fluorescent lamp at about 400 lax.

(5) Tone variability

Tone variability is represented by the percentage of dots given by 50% of the dots when the sample is exposed by an exposure amount which is 6 times the exposure amount at which 50% dots of UGRA-Offset-Testkeil, 1982 (Kohan Densitograph Trading Co., Ltd.) give 50% dot present. Samples having good tone variability shows at least 59%.

(6) Safety against external light

Safety against external light is represented by the irradiation time of a white fluorescent lamp (FL40SW manufactured by Toshiba Corporation) (said irradiation time causes that dots to be originally 50% are spread by 2%) when the sample is exposed to the fluorescent lamp at about 100 lax and developed (30' or more is good).

As is apparent from the results of Table 1, the samples of the present invention have good properties with regard to safety against external light as well as tone variability and satisfy performance requirements for high contrast and high Dmax.

TABLE 1

| Sample No. | Emulsion used | Dye dispersed in the form of fine solid particles added to filter layer: Compound No. | Amount (mg/m²) | Water-soluble dye added to backing layer: Compound No. | Amount (mg/m²) | Absorbance of backing layer at 360 nm |
|---|---|---|---|---|---|---|
| 1 | A | — | — | — | — | 0.08 |
| 2 | A | III-5 | 75 | — | — | 0.08 |
| 3 | A | — | — | Water-soluble dye No. 1 | 300 | 0.69 |
| 4 | A | III-5 | 75 | " | 130 | 0.30 |
| 5 | A | " | " | " | 215 | 0.50 |
| 6 | A | Water-soluble dye No. 2 | 70 | " | 300 | 0.69 |
| 7 | A | III-5 | 75 | " | 435 | 1.00 |
| 8 | A | " | " | Water-soluble dye No. 3 | 120 | 0.30 |
| 9 | A | " | " | " | 280 | 0.69 |

| Sample No. | Photographic performance: Sensitivity(1) | Dmax(2) | Gradation(3) | Safelight Property(4) | Tone variability(5) (%) | Safety against external light from backing layer(6) |
|---|---|---|---|---|---|---|
| 1 | 100 | 5.6 | 9.8 | 10' | 65 | 5' or less |
| 2 | 63 | 5.6 | 8.5 | 50' | 62 | 5' or less |
| 3 | 85 | 5.6 | 9.0 | 15' | 62 | 50' |
| 4 | 60 | 5.6 | 8.5 | 60' or more | 61 | 20' |
| 5 (Invention) | 54 | 5.6 | 8.5 | 60' or more | 61 | 40' |
| 6 | 54 | 5.3 | 7.5 | 60' or more | 55 | 50' |
| 7 | 50 | 5.6 | 8.4 | 60' or more | 58 | 60' or more |
| 8 | 60 | 5.6 | 8.5 | 60' or more | 61 | 20' |

TABLE 1-continued

| | | | | | | |
|---|---|---|---|---|---|---|
| 9 (Invention) | 54 | 5.6 | 8.5 | 60' or more | 60 | 50' |

Water-soluble dye No. 1

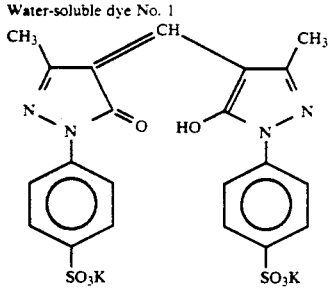

Water-soluble dye No. 2

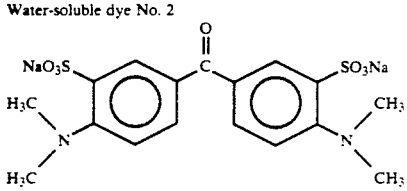

Water-soluble dye No. 3

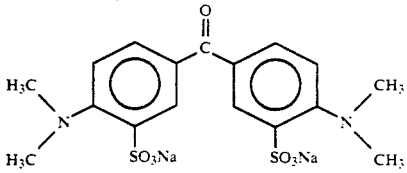

With regard to absorbance of the backing layer, only absorbance at 360 nm is shown in Table 1. However, both Sample Nos. 5 and 9 of the present invention have absorbance of 0.50 to 0.90 over the range of 320 to 400 nm.

EXAMPLE 2

Emulsion B was prepared in the same manner as in the preparation of Emulsion A except that $K_2Ru(NO)Cl_5$ was used in place of the transition metal used in Example 1. In the same manner as in Example 1, a coating step was carried out as shown in Table 2. The coated samples were developed at 38° C. for 15 seconds with the following developing solution and an automatic processor FG-710NH (manufactured by Fuji Photo Film Co., Ltd.). Evaluation of the samples was made in the same manner as in Example 1. The results are shown in Table 2.

It is clearly seen from the results of Table 2 that the samples of the present invention have good properties with regard to safety against external light as well as tone variability and satisfy the performance requirements with regard to high contrast and high Dmax even if super rapid processing is carried out.

TABLE 2

| Sample No. | Emulsion used | Dye dispersed in the form of fine solid particles added to filter layer: Compound No. | Amount (mg/m²) | Water-soluble dye added to backing layer: Compound No. | Amount (mg/m²) | Absorbance of backing layer at 360 nm |
|---|---|---|---|---|---|---|
| 1 | B | — | — | — | — | 0.08 |
| 2 | B | III-5 | 75 | — | — | 0.08 |
| 3 | B | — | — | Water-soluble dye No. 1 | 300 | 0.69 |
| 4 | B | III-5 | " | " | 110 | 0.25 |
| 5 | B | " | " | " | 215 | 0.50 |
| 6 | B | " | " | " | 300 | 0.69 |
| 7 | B | Water-soluble dye No. 2 | 70 | " | " | 0.69 |
| 8 | B | III-5 | 75 | " | 435 | 1.00 |
| 9 | B | " | " | Water-soluble dye No. 2 | 215 | 0.30 |
| 10 | B | " | " | " | 500 | 0.69 |
| 11 | A | I-1 | 80 | Water-soluble dye No. 1 | 215 | 0.50 |
| 12 | A | " | " | Water-soluble dye No. 3 | 200 | 0.50 |
| 13 | A | " | " | Water-soluble dye No. 2 | 355 | 0.50 |
| 14 | A | Water-soluble dye No. 2 | 70 | Water-soluble dye No. 1 | 215 | 0.50 |
| 15 | A | I-1 | 80 | " | " | 0.50 |
| 16 | A | " | " | " | 410 | 0.95 |

| Sample No. | Photographic performance: Sensitivity(1) | Dmax(2) | Gradation(3) | Safelight property(4) | Tone variability(5) (%) | Safety against external light from backing layer(6) |
|---|---|---|---|---|---|---|
| 1 | 100 | 5.3 | 9.9 | 10' | 65 | 5' or less |
| 2 | 63 | 5.3 | 8.6 | 50' | 62 | 5' or less |
| 3 | 85 | 5.3 | 9.1 | 15' | 62 | 50' |
| 4 | 62 | 5.3 | 8.6 | 60' or more | 61 | 15' |

TABLE 2-continued

| | | | | | | |
|---|---|---|---|---|---|---|
| 5 (Invention) | 56 | 5.3 | 8.6 | 60' or more | 61 | 40' |
| 6 (Invention) | 54 | 5.3 | 8.6 | 60' or more | 60 | 50' |
| 7 | 54 | 5.0 | 7.6 | 60' or more | 55 | 50' |
| 8 | 50 | 5.3 | 8.4 | 60' or more | 58 | 60' or more |
| 9 | 60 | 5.3 | 8.6 | 60' or more | 61 | 20' |
| 10 (Invention) | 54 | 5.3 | 8.6 | 60' or more | 60 | 50' |
| 11 (Invention) | 55 | 5.5 | 8.4 | 60' or more | 60 | 40' |
| 12 (Invention) | 55 | 5.5 | 8.4 | 60' or more | 60 | 40' |
| 13 (Invention) | 55 | 5.5 | 8.4 | 60' or more | 60 | 40' |
| 14 | 55 | 5.2 | 7.0 | 60' or more | 55 | 40' |
| 15 (Invention) | 55 | 5.5 | 8.4 | 60' or more | 60 | 40' |
| 16 | 50 | 5.5 | 8.3 | 60' or more | 58 | 60' or more |

| Developing solution | |
|---|---|
| 1-Hydroxy-ethylidene-1,1-diphosphonic acid | 2.0 g |
| Diethylenetriaminepentaacetic acid | 2.0 g |
| Sodium carbonate | 10.0 g |
| Potassium sulfite | 100.0 g |
| Potassium bromide | 10.0 g |
| Diethylene glycol | 20.0 g |
| 5-Methylbenztriazole | 0.2 g |
| Hydroquinone | 46.0 g |
| 4-Hydroxymethyl-4-methyl-1-phenyl-3-pyrazolidone | 1.0 g |
| Sodium 2-mercaptobenzimidazole-5-sulfonate | 0.3 g |
| Water to make | one liter |

pH was adjusted to 10.7 by adding potassium hydroxide.

It is clearly seen from the above results that in accordance with the present invention, good performance with regard to safety against external light, safety against safelight as well as tone variability can be obtained by fixing a dye dispersed in the form of fine solid particles in a protective layer which is a filter layer, and adding a water-soluble dye to the backing layer in such an amount as to give absorbance of 0.50 to 0.90 to ensure safety against safelight and safety against external light.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having on one side thereof (1) at least one light-sensitive silver halide emulsion layer and (2) at least one light-insensitive hydrophilic colloid layer containing a dye dispersed in the form of fine solid particles in which said light-sensitive silver halide emulsion layer is located between said support and said light-insensitive layer; and having on the other side thereof at least one light-insensitive backing layer, wherein said backing layer has an absorbance at 320 to 400 nm of 0.50 to 0.90; wherein said dye has an absorption maximum of 300 to 500 nm and is present in the light-insensitive hydrophilic colloid layer in an amount of 10 to 500 mg/m$^2$.

2. The silver halide photographic material as claimed in claim 1, wherein said backing layer contains a water-soluble dye in an amount of 50 to 2000 mg.

3. The silver halide photographic material as claimed in claim 2, wherein said water-soluble dye has a λmax of 350 to 600 nm.

* * * * *